United States Patent [19]

Goodspeed

[11] Patent Number: 4,748,004

[45] Date of Patent: May 31, 1988

[54] APPARATUS FOR CLEANING AIR PORTS OF A CHEMICAL RECOVERY FURNACE

[76] Inventor: Byron L. Goodspeed, 1111 Holcomb Rd., Kelso, Wash. 98626

[21] Appl. No.: 829,712

[22] Filed: Feb. 13, 1986

[51] Int. Cl.[4] ..... D21C 7/14

[52] U.S. Cl. ..... 422/185; 15/249; 162/48; 162/272

[58] Field of Search ..... 422/185; 162/48, 272; 266/269; 15/246, 249

[56] References Cited

U.S. PATENT DOCUMENTS

| | | | |
|---|---|---|---|
| 2,541,695 | 2/1951 | Gangevere | 422/185 |
| 2,911,284 | 11/1959 | Hochmuth | 422/185 |
| 3,403,642 | 10/1968 | Parkin | 422/185 |
| 3,413,936 | 12/1968 | Matthews | 422/185 |
| 3,477,823 | 11/1969 | Freiday | 422/185 |
| 3,607,117 | 9/1971 | Shaw et al. | 422/185 |
| 3,847,092 | 11/1974 | Gilbert | 422/185 |
| 3,870,467 | 3/1975 | Nelson | 422/185 |
| 4,423,533 | 1/1984 | Goodspeed | 266/269 |

*Primary Examiner*—Barry S. Richman
*Assistant Examiner*—William R. Johnson
*Attorney, Agent, or Firm*—Dellett, Smith-Hill & Bedell

[57] ABSTRACT

Removable apparatus for cleaning excrescent material from air ports in a chemical recovery furnace. A metal cleaning head having a cage-like configuration is pivotally mounted inside a wind box associated with the furnace to a frame adjacent an air port, and is adapted for insertion into the air port for cleaning the peripheral edges of the air port without blocking air flow through the port or obstructing the viewing path through the air port of sensing devices mounted exteriorly of the wind box. The frame to which the cleaning head is attached rests inside the wind box on the floor thereof, and is adjustably attached for positioning adjacent the air port to a mounting plate affixed to the outer wall of the wind box. The mounting plate pivotally carries an actuating cylinder which is coupled to the cleaning head by an actuating rod. The actuating cylinder moves the rod in a reciprocating cycle, first toward and then away from the cleaning head, causing the cleaning head to swing into the air port and clean char buildup along the edges thereof, and subsequently to withdraw from the air port. The rod and cylinder pivot freely by means of a mounting assembly attached to the mounting plate, as the cage swings into and out of the air port. The cleaning head incorporates a hook-like configuration which extends laterally inside the furnace above the upper edge of the air port where buildup of excrescent char is excessive.

18 Claims, 4 Drawing Sheets

APPARATUS FOR CLEANING AIR PORTS OF A CHEMICAL RECOVERY FURNACE

BACKGROUND OF THE INVENTION

The present invention relates to furnaces and particularly to apparatus for automatically cleaning ports introducing combustion air into the firebox of a chemical recovery furnace.

Wood pulp for papermaking is usually manufactured according to the sulfate process wherein wood chips are treated with a cooking liquor including sodium sulfide and sodium hydroxide. The wood chips and the cooking liquor, called "white liquor," are cooked in a digester under predetermined heat and temperature conditions. After cooking, the used liquor, termed "black liquor," containing spent cooking chemicals and soluble residue from the cook, is washed out of the pulp and treated in a recovery unit where the cooking chemicals are reclaimed. Without reclamation and reuse of the cooking chemicals, the cost of the papermaking process would be prohibitive.

In the recovery process, the black liquor is first concentrated by evaporation to a water solution containing about 65 percent solids, which solution is then sprayed into the firebox of a black liquor recovery boiler, a type of chemical reduction furnace. The chemical reduction furnace is a reactor wherein the processes of evaporation, gasification, pyrolysis, oxidation and reduction all occur interdependently during recovery of the cooking chemicals. The organic materials in the black liquor, lignin and other wood extracts, maintain combustion in the firebox, and the heat produced dries and melts the spent cooking chemicals as they fall to the floor of the firebox, where they build a mound of material called a char bed. The char bed is further heated to further liquify the chemicals into a molten smelt that flows out of the furnace through a smelt spout to a collection tank. Concurrently, combustion heat is employed to generate steam in a water wall of the boiler for use as process steam and for generating electricity.

The combustion process requires the introduction of large volumes of air into the firebox, air comprising about 80 percent of the material entering the furnace. The air is forced into the firebox from wind boxes or ducts disposed at several levels in surrounding relationship to the firebox, through a plurality of air ports in the walls of furnace, viz.: primary, secondary and tertiary air ports. The primary air ports, through which about 40 to 50 percent of the air enters the furnace, are disposed on the side walls of the firebox near the bottom of the surface close to the char bed. The secondary air ports, through which about 35 percent of the air enters the furnace, are disposed around the walls of the firebox, higher than the primary air ports, and below the entry conduits through which the black liquor is sprayed into the firebox. While the primary air ports provide a relatively large volume of air with considerable turbulence for maintaining a fireball in the char bed, the secondary air ports provide a finer control and distribution of air above the char bed and distribute the air evenly in the black liquor spray to support the combustion thereof.

The black liquor sprayed into the firebox, having a consistency like warm 60 weight oil, swirls, burns and falls toward the bottom of the firebox as combustion products comprising char material and smelt. The smelt and char material contact the outer walls of the firebox and, cooled by the inflowing air, form excrescent deposits around edges of the air ports, particularly along the top edges of the secondary air ports where the excrescent material builds up and outward under influence of air rushing through the secondary air port. Such buildup of char material can block air flow through a port by as much as ten percent. In accordance with customary practice, the char buildup is periodically removed by a worker inserting a rod into the air ports successively around the boiler. With manual rodding of the air ports, gradual buildup of char material intermittently around the furnace causes changes in the volume of combustion air, as well as changes in air distribution, velocity and pressure. Therefore, furnace operation tends to be inefficient and unpredictable with an attendant decrease in the amount of chemicals that can be recovered, a decrease in the amount of steam produced per unit of fuel, and increased emission of noxious gases such as carbon monoxide and sulfur dioxide.

Apparatus for cleaning openings in a recovery furnace are known—see my U.S. Pat. No. 4,423,533, entiled FURNACE AIR PORT CLEANER; however, such known apparatus is not always suitable for cleaning secondary air ports. Conventional punching devices, rods or cleaners inserted into the secondary air ports cannot dislodge the buildup of material above the top edge of the air port.

Monitoring devices such as pyrometers for sensing temperature inside the firebox and television cameras for viewing conditions in the furnace are often installed in the secondary air ports of recovery furnaces. Heretofore it has been necessary to remove such devices in order to clean deposits of excrescent material which build up around the secondary air ports interiorly of the firebox.

It is accordingly an object of the present invention to provide improved apparatus for cleaning air ports of a chemical recovery furnace.

It is another object of the present invention to provide improved air port cleaning apparatus installable in an air port of a chemical recovery furnace without interference to a sensing device associated with the air port in which the cleaning apparatus is installed.

Another object of the present invention is to provide improved air port cleaning apparatus for increasing the operational stability of a black liquor recovery boiler.

It is a further object of the present invention to provide improved air port cleaning apparatus for enhancing the efficiency of chemical recovery, increasing steam production, and reducing sulfur dioxide and carbon monoxide emissions from a black liquor recovery boiler.

SUMMARY OF THE INVENTION

According to the present invention, in a preferred embodiment thereof, furnace air ports are cleaned automatically by apparatus comprising a cleaning head adapted for insertion through a port and pivotally mounted to a frame adjacent to the port. The cleaning head is moved into the air port and partially inside the firebox vertically beyond an edge of the air port to dislodge excrescent material built up on the edge. Means are provided for moving the cleaning head into the port and for subsequently retracting the cleaning head after cleaning has been accomplished.

In a particular embodiment, mounting means are provided for removable attachment of the apparatus to an outer wall of a wind box, wherein the cleaning head actuating means is coupled through the wind box in substantial alignment with the air port and above an opening in the wind box through which a sensing means detects conditions inside the furnace through the air port, without obstructing the path through the wind box between the wind box opening and the air port.

In another embodiment of the invention, mounting means are provided for removable attachment to the outer wall of the wind box wherein the cleaning head actuating means is supported for pivotal and reciprocating movement through the wind box wall and preferably includes a fulcrum block for slidably receiving an actuating rod, and bearing means for rotatably supporting the fulcrum block and providing an air seal between the fulcrum block and the wall of the wind box.

In accordance with a particular embodiment of the invention, shield plates are provided on the cleaning apparatus for insertion into the air port to protect boiler tubes located inside the furnace from damage due to contact by the moving cleaning head.

In another embodiment according to the present invention, the cleaning head is constructed as an open metal cage-like structure substantially the size of the air port, so as to sweep along all the edges of the air port when inserted therein to dislodge excrescent material or char buildup therefrom.

The apparatus according to the present invention is easily removable from and adjustable with respect to the air port. In particular, the apparatus is mounted to the external wall of the wind box and is slidably adjustable toward the air port by way of adjusting means exteriorly of the wind box. For repair servicing, the apparatus according to the present invention is easily removed from the wind box.

The apparatus according to the instant invention is suitably operated at regular intervals on an automatically timed basis so as to keep the air port substantially clear of excrescent material, resulting in improved stability of furnace operation. Consequently more efficient recovery of chemicals is realized as well as an increase in steam production and decrease in the emission of pollutant gasses. While only one apparatus according to the present invention is illustrated and described herein, it is understood that a plurality of such apparatus are ordinarily disposed around a particular firebox so as to clean a comparatively large number of air inlets. The separate apparatus can be operated either simultaneously or sequentially.

DRAWINGS

While the invention is set forth with particularity in the appended claims, other objects, features, the organization and method of operation of the invention will become more apparent, and the invention will best be understood by referring to the following detailed description in conjunction with the accompanying drawings, in which:

DESCRIPTION OF THE PREFERRED EMBODIMENT

Figure 1:
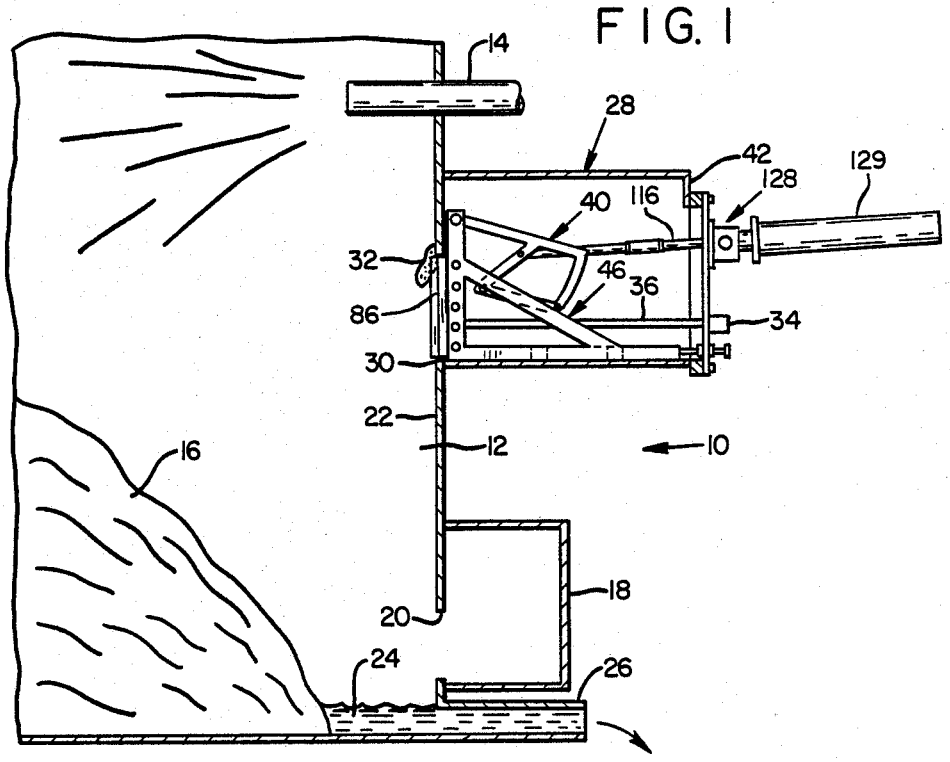
FIG. 1 is a schematic view of a portion of a black liquor recovery boiler with which the present invention is employed.

Referring now to the various views of the drawing for a more detailed description of the construction, function, operation and other features of the instant invention by characters of reference, FIG. 1 shows a black liquor recovery boiler 10 which comprises a firebox 12 of a steam boiler. Black liquor, as hereinbefore described, is sprayed into the firebox 12 through a conduit 14, where the organic materials therein are ignited, the chemicals being deposited on the floor of the firebox as a char bed 16. A first wind box 18 substantially surrounds the firebox 12 and delivers combustion air under pressure into the firebox through a plurality of primary air ports 20 formed in the wall 22 of the firebox 12 around the periphery thereof at the level of the char bed 16 to maintain a fireball in the char bed. A molten chemical-containing smelt 24 is recovered from the burning char bed 16 through smelt spouts 26 disposed in the bottom of the firebox 12, the smelt being collected for further treatment.

A second wind box 28 substantially surrounds the firebox 12 and delivers combustion air under pressure into firebox through a plurality of secondary air ports such as air port 30 formed in the wall 22 of the firebox 12 around the periphery thereof above the char bed 16 and below the level of the black liquor entry conduit 14 for supporting the initial combustion of the organic materials in the black liquor. As previously described herein, excrescent material 32 comprising hardened smelt and char material forms on the walls 22 of the firebox, particularly above the edges of the secondary air ports 30 as illustrated in FIG. 1.

In accordance with the present invention, apparatus 40 for cleaning the air ports 30 is attached to an outer wall 42 of the second wind box 28, and is adapted to clean the excrescent material 32 from the wall 22 of the firebox adjacent the air port 30. A sensing device 34 such as a pyrometer or a television camera for detecting conditions inside the firebox 12 may be mounted on the wind box 28, and may include an extendable rod-like sensing element 36 which extends through the wind box 28 to the air port 30. The apparatus 40 of the present invention is adapted to clean secondary air ports with such sensing devices installed.

Referring now to FIGS. 2–6 illustrating apparatus 40 in greater detail, the apparatus comprises a frame 44 having a base member 46 resting on the floor 48 of the wind box 28 and constructed from a pair of steel bars 50, 52 disposed in parallel relation with each other, and joined spaced apart by cross members 54, 56. The base member 46 is attached by bolts 58, 60 to a mounting plate 62 covering an access opening 64 in the outer wall 42 of the wind box. The mounting plate 62 is attached by bolts 66 to a rectangular frame 68 suitably made from flat steel bar stock and welded to the wall 42 of the wind box 28 around the periphery of the access opening 64. The frame 44 further comprises a pair of stanchions 70, 72 attached to the base member 46 as by welding and supported by struts 74, 76 in parallel relation with one another. The stanchions 70, 72, held spaced apart from each other at the upper ends thereof by a trunnion 78, abut an exterior wall 80 of the firebox at the secondary air port 30 of the firebox. Rectangular guide plates 84, 86 attached to the stanchions by bolts 88 extend from the upright stanchions through the air port 30 and into the boiler, serving to guide the apparatus 40 into position adjacent the air port 30 upon installation in the wind box 28, and to protect boiler tubes 90 from damage by moving parts of the cleaning apparatus, as explained hereinafter. Each of the guide plates 84, 86 includes an inwardly beveled area 92 on the outwardly facing surface thereof to guide the plate through the air port 30.

A cleaning head 100 of the apparatus 40 comprises a cage-like structure affixed as by welding to a cylindrical sleeve 101 pivotally mounted to the frame 44 by trunnion 78 passing through the sleeve 101. The cleaning head 100, configured as an open, generally polyhedral cage, is adapted to pass rotatably through the rectangular air port 30 dislodging excrescent material 32 from around the edges of the air port as the cleaning head 100 is inserted and then withdrawn from the opening. The primary cleaning feature of the cleaning head 100 is embodied in a hook-like implement 102 comprising a pair of arms 104, 106 extending in parallel relationship from the trunnion 78 and a corresponding pair of bars 108, 110 depending from the arms 104, 106 at an acute angle therewith, the bars 108, 110 being spaced apart in parallel relation by an end cross member 112 at the ends of the bars 108, 110, and by a trunnion 114 near the juncture of the bars and the arms 104, 106. An actuating rod 116 is rotatably attached to the trunnion 114 by a sleeve 118 to which the rod 116 is welded. The arms 104, 106 extend beyond the bars 108, 110 and form sides of quadrilateral structures 120, 122 including forward arms spaced apart by an optional cross member 124. The cross member 124 may be omitted to form a bifurcated cage-like structure, i.e., the region between the quadrilateral structures 120, 122 being open in order to preclude interference by the cleaning head 100 with sensing elements which may be mounted inside the wind box. Alternatively, stiffening cross members may be located on the cleaning head 100 at other non-interfering locations such as indicated by dashed lines at 126 in FIG. 4. The cleaning head 100 is suitably constructed of metal such as stainless steel.

Figure 3:
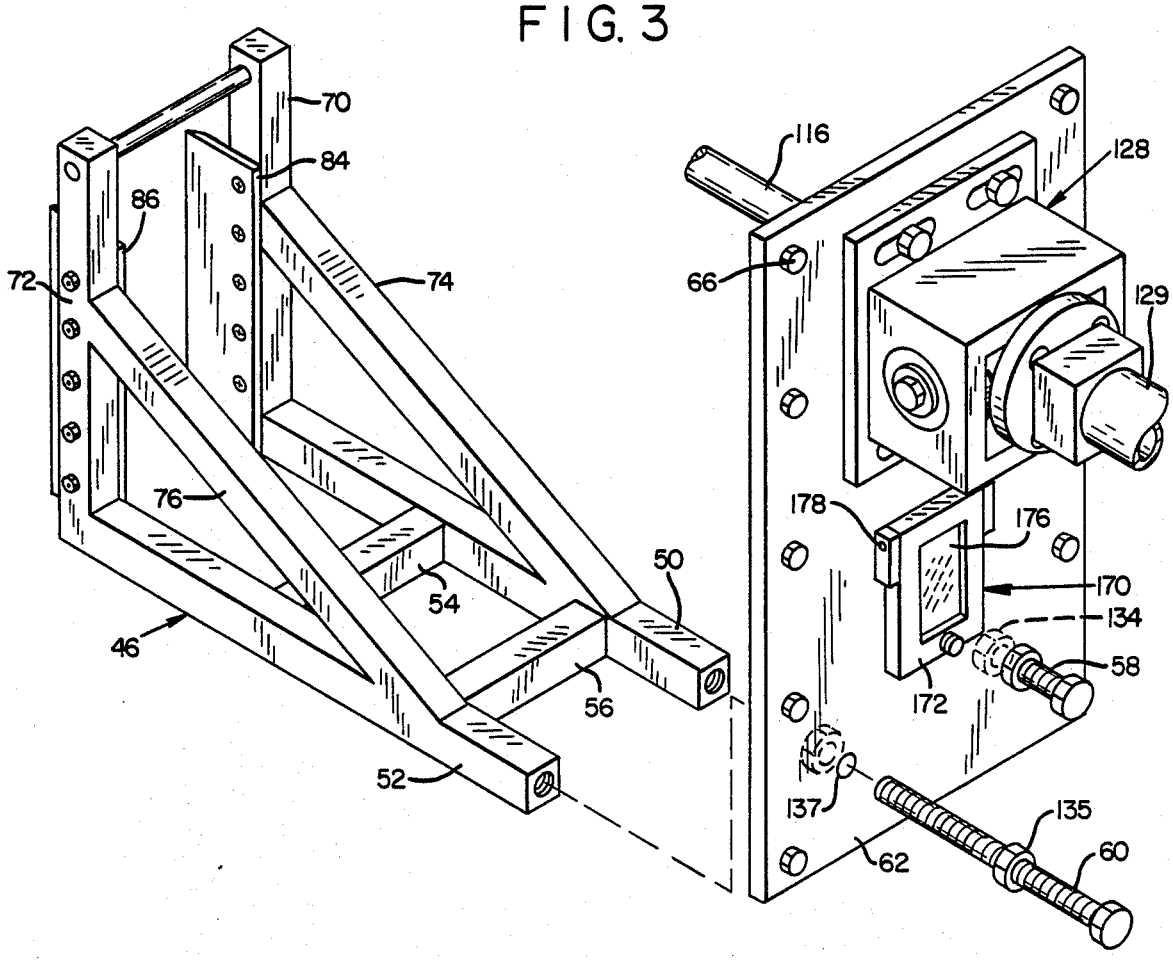
FIG. 3 is an exploded perspective view of a portion of the FIG. 2 apparatus.
Figure 2:
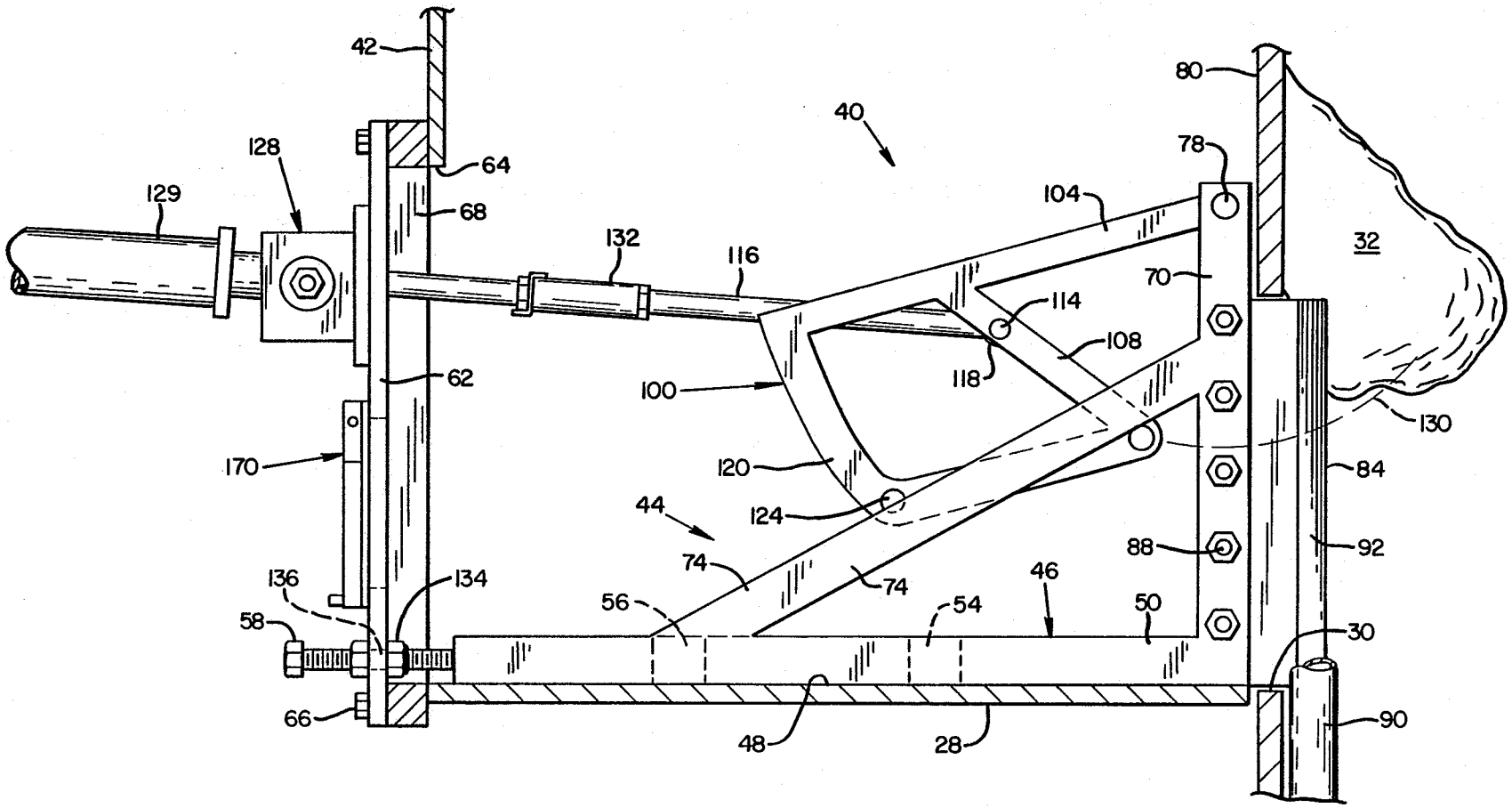
FIG. 2 is a side elevation view of apparatus according to the instant invention.
Figure 4:
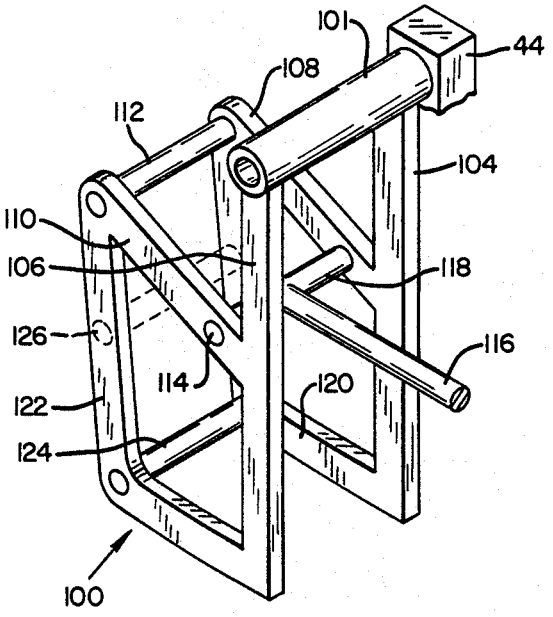
FIG. 4 is a perspective view of a cleaning head of apparatus according to the present invention.

Referring to FIGS. 2 and 3, the actuating rod 116 is connected pivotally and slidably through a mounting assembly 128 to an actuating cylinder 129, preferably an air operated cylinder, for slidably advancing the rod 116 toward the air port 30. It will be observed that advancing the rod 116 swings the cleaning head 100 forwardly on pivot 78 into the air port 30, the end of bar 10B (for example) defining a locus indicated by the dashed line 130 so that the bar 108 contacts and dislodges the excrescent material 32. The rod 116 is provided with an adjusting means such as turnbuckle 132 for adjusting the length of the actuating rod 116 upon installation of the cleaning apparatus 40 in the wind box 28. The frame 44 of cleaning apparatus 40 is slidably positionable in the windbox 28 toward the air port 30 by turning the bolts 58, 60, which are conventionally threaded into bars 50, 52, for forcing bearing members 134, 135 welded, respectively, to bolts 58, 60, against mounting plate 62, thereby to move the frame 44 toward the air port 30. Holes 136, 137 in the mounting plate 62, through which the bolts 58, 60 pass, are not threaded.

Figure 7:
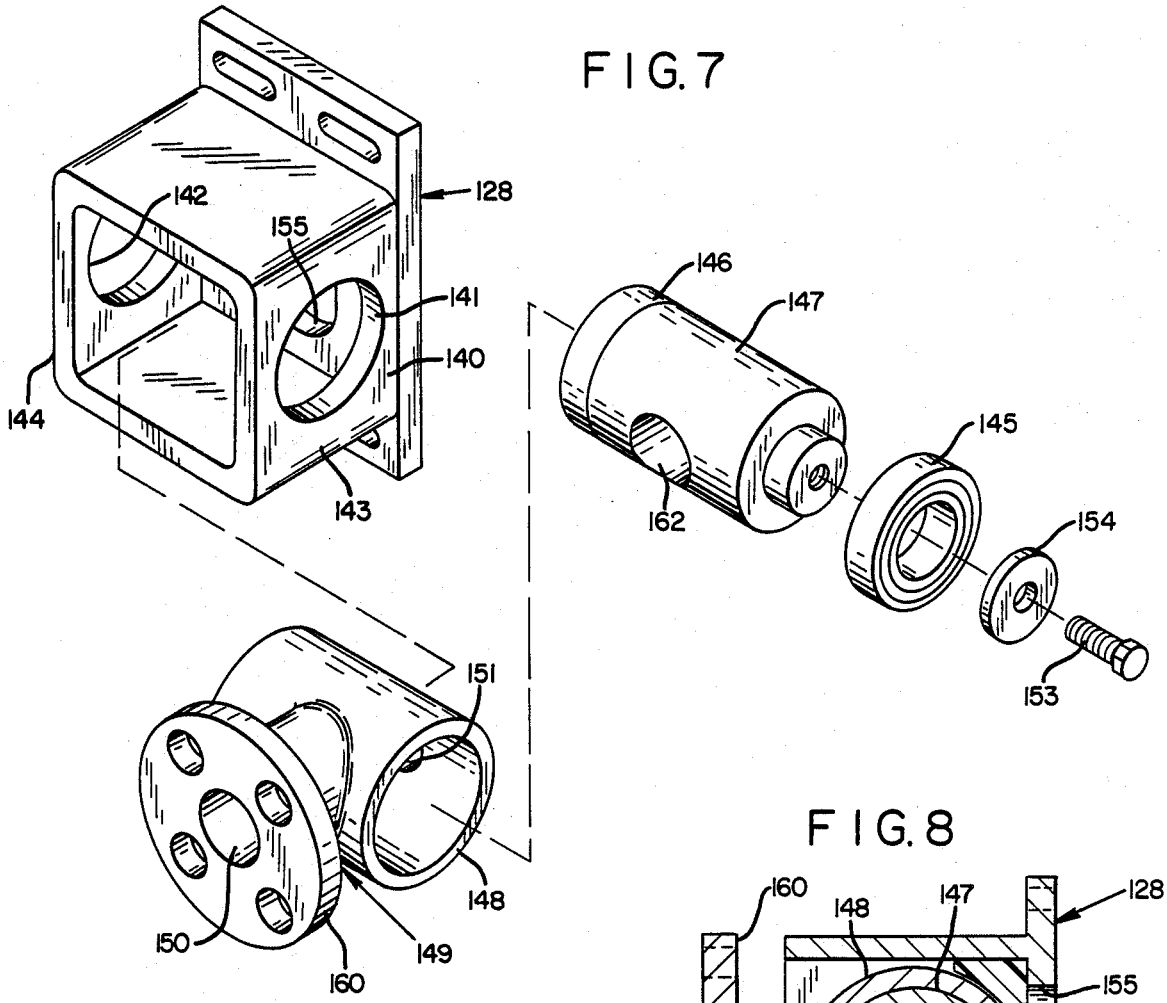
FIG. 7 is an exploded view of a mounting means according to the present invention.
Figure 8:
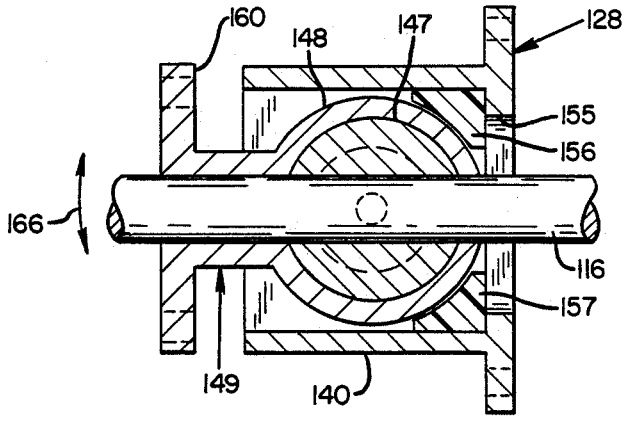
FIG. 8 is a transverse cross section of the FIG. 7 means.

Referring to FIGS. 2, 7 and 8, the mounting assembly 128 for pivotally end slidably mounting the actuating rod 116 to the mounting plate 62 includes a housing 140 having a transverse bore 141, 142 through both side walls 143, 144 thereof for receiving bearings 145, 146 mounted on a rotating cylinder 147, which acts as a fulcrum. The cylinder 147 is received slidably into a cylindrical sleeve 148 of T-shaped member 149, which includes a bore 150 perpendicular to the axis of the sleeve 148, which bore 150 extends through the back wall 151 of the sleeve 148 for slidably receiving and supporting the rod 116. The cylinder 147 is adapted to receive the bearing 145 through which a bolt 153 extends for threadable engagement in an end of the cylinder 147. A lock washer 154 is suitably disposed between the head of the bolt 153 and the bearing 145. The housing 140 is also provided with a vertically elongated opening 155 through which the actuating rod 116 extends, and teflon seals 156, 157 in the rear corners of the housing. This construction provides an effective air seal for preventing the escape of any substantial amount of air from the wind box while allowing pivoting motion of the rod 116. The mounting assembly 128 is provided with a flange 160 integral with the T-shaped member 149 for attaching the cylinder 129 for movement therewith. The cylinder 129 is thus free to pivot in the direction indicated by the arrows 166, FIG. 8, as the rod 116 effects eccentric motion in response to the cleaning head swinging into and out of the air port 30 during a cleaning cycle.

Figure 6:
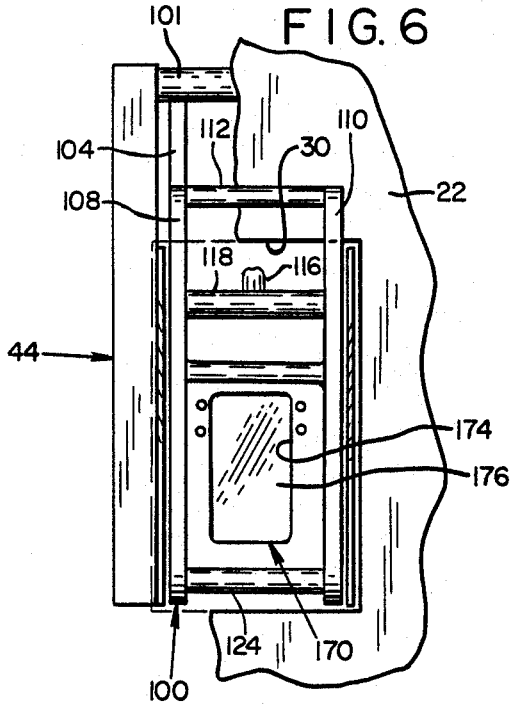
FIG. 6 is a modified cross section, partially broken away, of apparatus according to the present invention, taken at 6—6 of FIG. 5.

For the purpose of observing conditions inside the firebox, and for access to the firebox through the wind box 28, an access port 170 is provided. Referring to FIGS. 3 and 6, a frame 172, secured to the mounting plate 62 over a rectangular opening 174 (see FIG. 6), holds a pyrex glass plate 176 against the opening 174, providing a viewing port. The frame 172 may be swung open on pivot 178, or removed, to install a sensing device such as a pyrometer or a television camera (34 in FIG. 1) in the opening 174. Alternatively a camera or pyrometer may be mounted at a separate viewing port in mounting plate 62.

Figure 5:
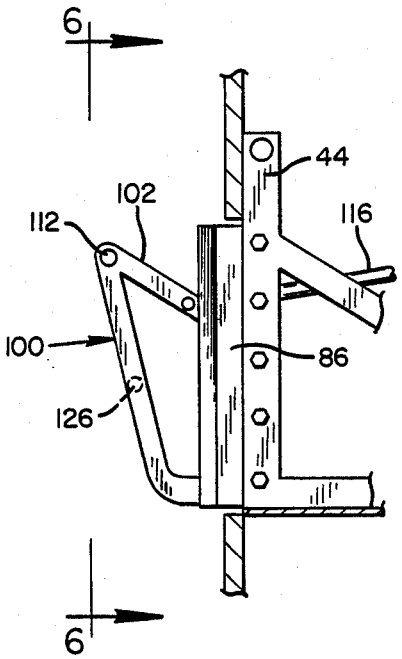
FIG. 5 is a side elevation view of a portion of apparatus according to the present invention showing the cleaning head extended into air port.

FIG. 2 illustrates the cleaning head 100 in an at-rest or retracted position, withdrawn from the air port 30. It will be observed that the temperature inside the firebox is normally much hotter than in the wind box where the cleaning head 100 normally resides and consequently the cleaning head is protected to a degree from the excessive temperature of the firebox except for a brief period of use. At timed intervals, e.g. about every thirty minutes, the cylinder 129 is actuated for swinging the cleaning head 100 into the air port 30 to the position as illustrated in FIG. 5. The cylinder 129 is then operated in the reverse direction for retracting the cleaning head 100 from the firebox back to its original at-rest position. It will be seen that when the cleaning head 100 is fully engaged into the air port 30 the end 112 of the hook-shaped implement of the cleaning head 100 rises substantially above the upper edge of the air port, while forward arms of the head sweep substantially the entire cross sectional area of the opening. It is also observed that access to the air port 30 from the access port 170 is unobstructed by the cleaning head 100.

Figure 10:
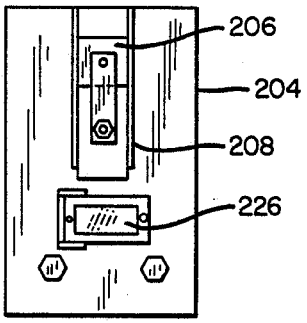
FIG. 10 is an end elevation view of the apparatus of FIG. 9.
Figure 9:
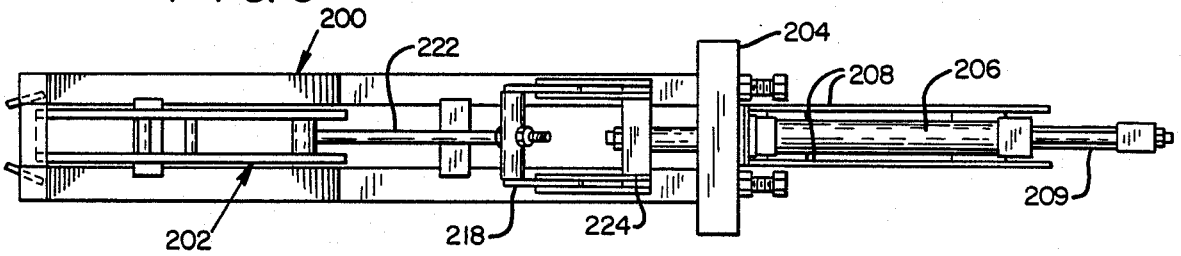
FIG. 9 is a plan view of an alternate embodiment of cleaning apparatus in accordance with the present invention.
Figure 11:
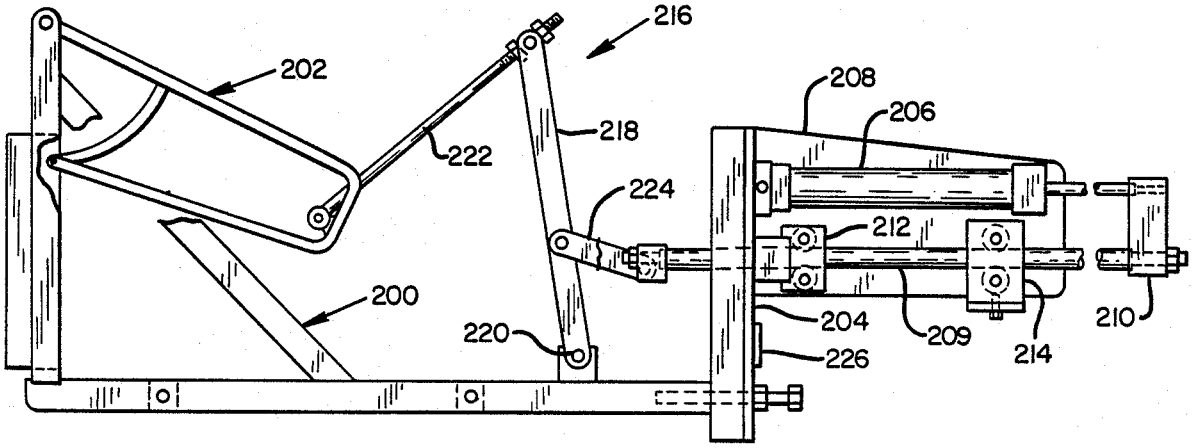
FIG. 11 is a side elevation view of the apparatus of FIG. 9.

Referring now to FIGS. 9–11, apparatus in accordance with an alternative embodiment of the present invention comprises a frame 200, a cleaning head 202, and a mounting plate 204 substantially as previously described with reference to FIGS. 2–6. An actuating cylinder 206, preferably air operated, is affixed rigidly to the mounting plate 204 and to a planar mounting member 208 extending perpendicularly from the mounting plate 204. The actuating cylinder 206 is adapted to move actuating rod 209 by way of linkage 210 in reciprocating motion, first toward, and then away from the cleaning head 202, the rod 209 being mounted for said reciprocating motion in roller assemblies 212, 214 affixed, respectively, to mounting plate 204 and mounting member 208.

A linkage assembly 216, which translates the reciprocating motion of the rod 208 to eccentric motion of the cleaning head 202, comprises a rectangular coupling yoke 218 affixed rotatably at one end thereof to the frame 200 by pivot 220. A connecting rod 222 is pivotally connected from the other end of the yoke 218 to the cleaning head 202, and a connecting link 224 connects the actuating rod 209 to the yoke 218. A viewing port 226 is provided through the mounting plate 204, and as with the previously described embodiment of the invention, a sensing device may be mounted thereto and a clear sight is maintained through the cleaning apparatus 200.

A plurality of units of the apparatus according to the present invention are ordinarily installed on a single firebox for the same boiler. The operations of the units are timed by timing means, not shown, to be substantially completely automatic for inserting the cleaning heads periodically for quickly cleaning the air ports during furnace operation.

In addition to providing improved efficiency of boiler operation, the present invention enhances operating safety, not only in eliminating the need for manual cleaning, but also in stabilizing the char bed, which reduces the danger of hot spots and boiler tube rupture.

In addition to performing a cleaning function, the cleaning head may alternatively or additionally be employed as a damper to control flow rate or velocity through the air port. For this purpose, the cage-like structure of the head is enclosed, and the frame 44 is partially or completely enclosed or walled in, so that, for a given position of the head, air flow tends to be closed off. The head may then be varied from this position to accomplish cleaning or to effect a differing air flow.

While the principles of my invention have now been made clear in the foregoing illustrative embodiments, there will be immediately obvious to those skilled in the art many modifications of structure, arrangement, proportions, the elements, material and components used in the practice of the invention, and otherwise, which are particularly adapted for specific environments and operating requirements without departing from those principles. The appended claims are, therefore, intended to cover and embrace any such modifications, within the limits only of the true spirit and scope of the invention.

I claim:

1. Apparatus for cleaning an opening in a firebox, said apparatus comprising:

a cleaning element having a first hook-shaped member;

means for mounting said cleaning element adjacent to an opening in a firebox, said first hook-shaped member having first and second ends, said cleaning element being pivotally mounted toward the first end of said hook-shaped member to said mounting means, said cleaning element being adapted for movement of the second end between a first, retracted, position and a second, extended position, whereby the second end defines a locus sweeping inside the firebox and upwardly with respect to the opening substantially beyond an upper edge of the opening; and actuating means affixed to said mounting means for providing the movement of said cleaning element, whereby the extension of said second end dislodges excrescent material inside the upper edge of the opening.

2. The apparatus according to claim 1 wherein said cleaning element further comprises an arm extending from said first hook-shaped member wherein said extending arm sweeps substantially the entire length of the opening when said cleaning element is extended from the first to the second position.

3. The apparatus according to claim 2 wherein said cleaning element is bifurcated to allow visual access between bifurcations of said cleaning element.

4. The apparatus according to claim 2 wherein said first hook-shaped member and said extending arm form an open, generally rectangular polyhedral cage, which allows visual access through openings within said cage.

5. The apparatus according to claim 2, further comprising:

said cleaning element includes a second hook-shaped member having an arm extending therefrom, at least one cross member holding the first and second hook-shaped members and the extending arms spaced apart in substantial parallel relation whereby the cleaning element sweeps lateral edges of the opening when said cleaning element is moved from the first to the second positions, and wherein the space defined between the spaced-apart elements of said cleaning element provides visual access through said cleaning element.

6. In an apparatus for cleaning a port introducing air into a furnace, said furnace being provided with a wind box for supplying air under pressure to said port, said furnace being subject to a buildup of excrescent material along an upper edge of said port inside said furnace, wherein the improvement comprises:

a cleaning head insertable through said port;

means mounted in said wind box for pivotally mounting said cleaning head adjacent said port;

means mounted to said wind box and coupled to said cleaning head for rotatably moving said cleaning head so as to insert a portion of said cleaning head into said port and inside said firebox vertically beyond said upper edge of said port, thereby contacting and dislodging excrescent material inside said upper edge, and for subsequently retracting said portion of said cleaning head from said port.

7. The apparatus according to claim 6 wherein said port is rectangular and said cleaning head comprises a metal frame sweeping at least three peripheral edges of said rectangular port when said cleaning head is inserted into said rectangular port.

8. The apparatus according to claim 6 wherein said port is rectangular and said cleaning head comprises an open rectangular frame sweeping the peripheral edges of said rectangular port when said cleaning head is inserted into said rectangular port.

9. The apparatus according to claim 6 wherein said furnace includes boiler tubes located inside and abaxially of said port, and the improvement further comprises means attached to said mounting means and extending into said port for shielding said boiler tubes from contact by said cleaning head when said cleaning head is inserted into said port.

10. In an apparatus for cleaning an air port located in a wall of a firebox, said firebox being provided with a wind box supplying air under pressure to said air port, said wind box having an outer wall spaced apart from the wall of said firebox, said firebox being subject to a buildup of excrescent material along an upper edge of said air port inside said firebox, wherein the improvement comprises:

a cleaning head having a pivot;

first means in said wind box for pivotally mounting said cleaning head adjacent said air port, said cleaning head being rotatably movable about said pivot so as to insert a portion of said cleaning head into said air port and inside said firebox vertically beyond the upper edge of said air port, thereby contacting and dislodging the buildup of excrescent material inside the upper edge of said air port;

means coupled to said cleaning head for moving said cleaning head into and subsequently out of said air port;

second mounting means for attaching said first mounting means to the outer wall of said wind box, said first and second mounting means and said cleaning head being removable as a unit from said wind box, said second mounting means further comprising a mounting plate fastenable to the outer wall of said wind box, and means for supporting said moving means for reciprocating movement through said mounting plate.

11. The apparatus according to claim 10 wherein said moving means includes means for translating a reciprocating motion of said moving means to the rotational motion of said cleaning head.

12. The apparatus according to claim 10 wherein said supporting means includes means for supporting said moving means for pivotal movement with respect to said second mounting means.

13. The apparatus according to claim 10 wherein said cleaning head comprises a hook-shaped member having first and second ends, the first end being attached to said first mounting means, said moving means being pivotally attached to said hook-shaped member intermediate the first and second ends thereof, the second end of said hook-shaped member being insertable through said air port inside said firebox vertically beyond the upper edge of said air port when said moving means is actuated to thereby contact and dislodge excrescent material from inside said upper edge.

14. The apparatus according to claim 10 wherein said first mounting means and said cleaning head are each at least partially enclosed so as to restrict air flow into said air port according to the relative positions of said first mounting means and said cleaning head.

15. The apparatus according to claim 10 wherein said mounting plate includes an opening defined therethrough and said apparatus further comprises means mounted in said opening for remotely sensing through said air port conditions inside said firebox, said opening being located below the level of said moving means and said cleaning head when said cleaning head is in a retracted position to provide a clear path between said opening and said air port.

16. The apparatus according to claim 15 wherein said air port is rectangular and said cleaning head comprises a metal frame sweeping at least three peripheral edges of said rectangular air port without blocking said clear path between said opening and said air port when said cleaning head is inserted into said air port.

17. The apparatus according to claim 15 wherein said air port is rectangular and said cleaning head comprises an open rectangular frame sweeping the peripheral edges of said air port when said cleaning head is inserted into said rectangular air port.

18. The apparatus according to claim 15 wherein said sensing meane comprises a plate of glass for optically viewing the interior of said firebox.

* * * * *

UNITED STATES PATENT AND TRADEMARK OFFICE

CERTIFICATE OF CORRECTION

PATENT NO. : 4,748,004

DATED : May 31, 1988

INVENTOR(S) : BYRON L. GOODSPEED

It is certified that error appears in the above-identified patent and that said Letters Patent is hereby corrected as shown below:

Column 5, line 65, "10B" should be --108--.

Column 10, line 44, "meane" should be --means--.

Signed and Sealed this

Twenty-seventh Day of February, 1990

*Attest:*

JEFFREY M. SAMUELS

*Attesting Officer*

*Acting Commissioner of Patents and Trademarks*